US005535881A

United States Patent [19]

Krivec

[11] Patent Number: 5,535,881

[45] Date of Patent: Jul. 16, 1996

[54] CROWFOOT WRENCH HOLDER

[75] Inventor: Bert Krivec, Waukesha, Wis.

[73] Assignee: Snap-on Technologies, Inc., Crystal Lake, Ill.

[21] Appl. No.: 422,806

[22] Filed: Apr. 17, 1995

[51] Int. Cl.[6] ..... B65D 85/28; A47F 7/00

[52] U.S. Cl. ..... 206/376; 206/377; 206/477; 206/483; 211/70.6; 211/89

[58] Field of Search ..... 206/376/377, 378, 206/477, 483; 211/70.6, 89

[56] References Cited

U.S. PATENT DOCUMENTS

| | | | |
|---|---|---|---|
| 2,357,646 | 12/1942 | Gilbert . | |
| 2,530,307 | 4/1948 | Leach . | |
| 2,591,805 | 6/1950 | Gossett . | |
| 2,639,815 | 5/1953 | Paluck . | |
| 3,762,570 | 10/1973 | Tobin . | |
| 3,876,076 | 4/1975 | Hazelhurst . | |
| 3,980,608 | 9/1976 | Faltersack . | |
| 4,310,094 | 1/1982 | Hotchkiss, Jr. . | |
| 4,497,405 | 2/1985 | Mikic et al. . | |
| 4,930,641 | 6/1990 | Dale . | |
| 4,941,571 | 7/1990 | Barrett et al. | 206/378 |
| 4,941,577 | 7/1990 | Ferree et al. . | |
| 5,316,143 | 5/1994 | Horn . | |

*Primary Examiner*—Paul T. Sewell
*Assistant Examiner*—Marie Denise Patterson
*Attorney, Agent, or Firm*—Emrich & Dithmar

[57] ABSTRACT

The wrench holder has a plurality of pairs of elements separated by a space substantially equal to the thickness of a wrench. One element in each pair is fixed and the other is hingedly mounted for movement toward and away from the first element. Two bosses are respectively carried by the two elements and are directed laterally toward each other. A wrench is inserted into a space, forcing the second element away from the first until the bosses are aligned with a hole in wrench, whereupon the two bosses seat within the wrench hole.

14 Claims, 1 Drawing Sheet

50
35
45
40
30
20

45
7/16
35
40
37
36
38
62
51
30

45
4
5/8
11/16
51

5
29
25
27
45
40
35
42
41
37
36
38
28
43
51
30
26
38

29
27
25
40
42
41
43
26
51
30

29
25
27
REMOVE
40
28
41
26
30

29
INSERT
25
27
28
26
40
62
41
30

29
27
25
40
61
41
30
60

60
61

CROWFOOT WRENCH HOLDER

This application relates to a holder for a plurality of crowfoot wrenches.

BACKGROUND OF THE INVENTION

U.S. Pat. No. 4,497,405, assigned to the assignee of the present application, discloses a crowfoot wrench holder which comprises a pair of elongated, plastic members that slide or telescope together. The disadvantage of this holder is that when it is desired to select a certain wrench, it cannot simply be removed. Instead, the two members must be separated, the selected wrench removed and then the plastic members telescoped back together. Or, the two groups can remain separated until use of the selected wrench is completed and put back; then the members are telescoped together. Also, the prior patented device could not accommodate markings of the different sizes of the wrenches.

SUMMARY OF THE INVENTION

It is, therefore, an important object of the present invention to provide an improved crowfoot wrench holder which enables ready removal and insertion of a selected wrench without affecting the other wrenches.

It is another object of the present invention to provide a crowfoot wrench holder which has structure to accommodate size markings for the individual wrenches.

In summary, there is provided a holder for a plurality of crowfoot wrenches each including a wrench head carried by a body having a hole therein, the holder comprising an elongated strip, a plurality of first elements carried by and upstanding on the strip, a plurality of second elements alternating with the first elements, the second elements being mounted for hinged movement respectively with respect to the first elements, thereby to define a plurality of spaces between the first and second elements, a wrench being insertable in and removable from a selected one of the spaces by hinging the associated second element away from the associated first element, a plurality of first bosses respectively on the first elements and extending laterally with respect thereto, and a plurality of second bosses respectively on the second elements and extending laterally with respect thereto, the first and second bosses extending into the spaces and defining pairs extending toward each other into the spaces, each of an associated pair of the first and second bosses extending into the hole of a wrench located in the associated one of the spaces.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
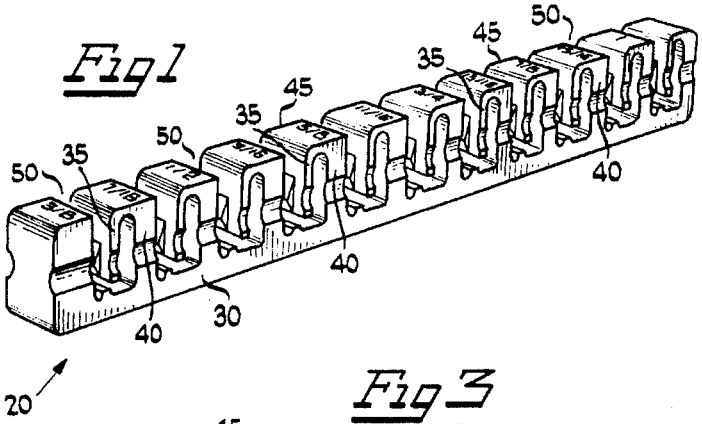
FIG. 1 is a perspective view of a crowfoot wrench holder incorporating the features of the present invention.
Figure 2:
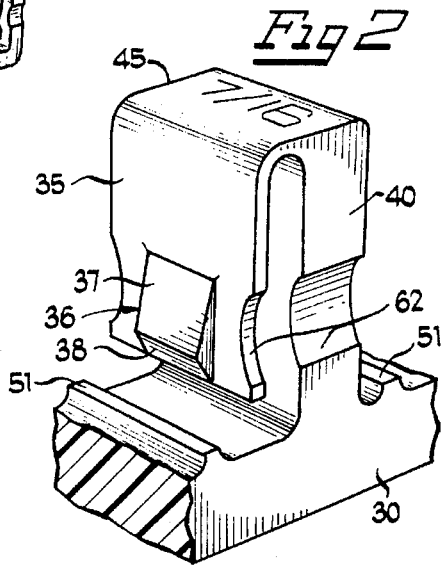
FIG. 2 is an enlarged, fragmentary, perspective view of a portion of the wrench holder of FIG. 1.
Figure 3:
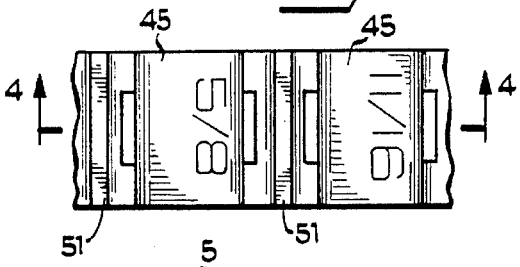
FIG. 3 is an enlarged top plan view of a fragmentary portion of the wrench holder of FIG. 1.

Referring now to FIGS. 1–5 of the drawings, there is depicted a holder 20 incorporating the features of the present invention. The holder 20 is used to hold eleven wrenches 25 (FIG. 5) although it can be designed to accommodate any number. Each wrench includes a body 26 and a head 27. A square hole 28 is used to connect to a driver (not shown) such as a ratchet. Head 27 has an open end defining a driving surface 29. The driving surface 29 has a size depending upon the size of the fastener to be driven. For example, its size may be as small as ⅜" or as large as 1". The sizes may be marked onto the holder 20 as shown in FIGS. 1, 3.

Holder 20 comprises an elongated strip 30 and a plurality of elements 40 upstanding on strip 30 and a plurality of elements 35 alternating with elements 40. In the embodiment depicted, holder 20 includes eleven elements 35 and eleven elements 40, corresponding to the number of wrenches to be held. Elements 35 are relatively thin and flexible while elements 40 are relatively thick and rigid. Elements 35 and 40 are plate-like in the preferred form and are substantially parallel. Each element 35 and its associated element 40 to its left, as viewed in FIG. 1, defines a space 50 therebetween. At the bottom of each space 50 is a foot 51.

Elements 35 and 40 are connected by associated hinges 45 at points remote from strip 30. Each element 35 carries a boss 36 extending laterally therefrom. Each boss 36 has a camming entry surface 37 and a camming exit surface 38. Each element 40 carries a boss 41 extending laterally therefrom. Each boss 41 has a camming entry surface 42 and a camming exit surface 43. Bosses 36 and 41 associated with a particular space 50 extend toward each other and into such space. In a preferred embodiment, holder 20 is integral and one-piece, elements 35, 40, hinges 45 and bosses 36, 41 being composed of plastic. In a particular embodiment, each boss 36, 41 is square in outline, having a shape corresponding to the square hole 28 in wrench 25.

Figure 4:
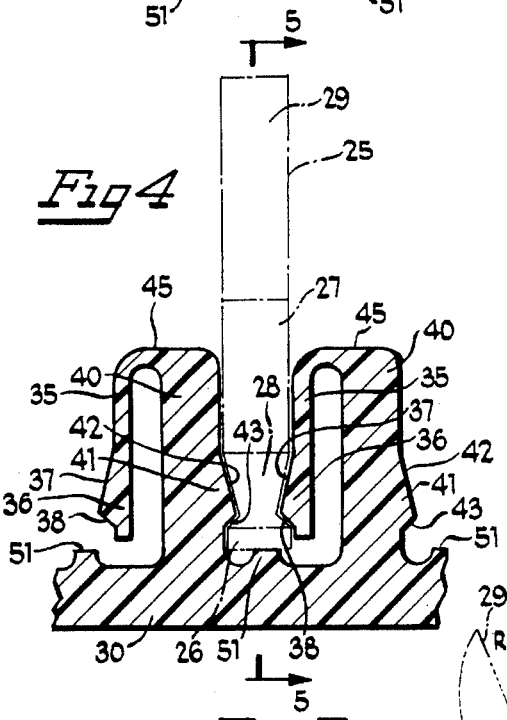
FIG. 4 is a view in vertical section taken along the line 4—4 in FIG. 3 with a wrench in position shown in phantom.
Figure 5:
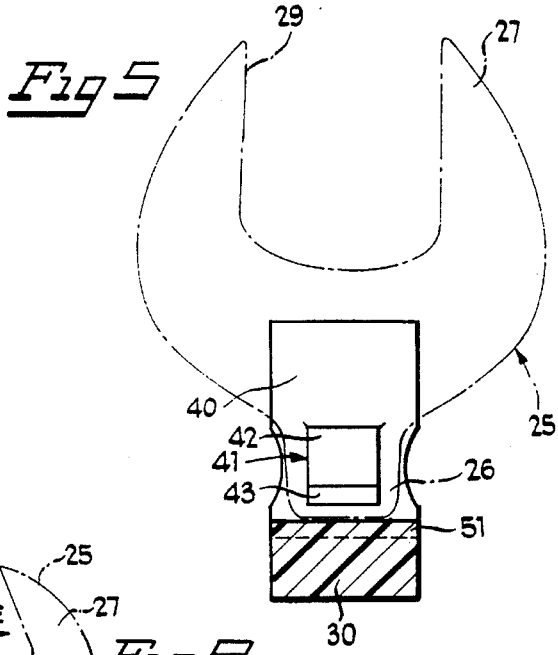
FIG. 5 is a sectional view taken along the line 5—5 of FIG. 4, with the wrench depicted in phantom.
Figure 7:
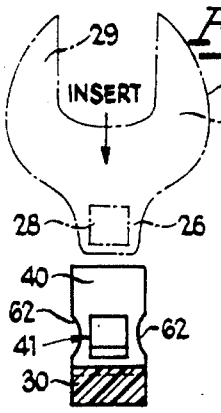
FIG. 7 is a reduced view like FIG. 5 but showing the wrench being inserted.
Figure 8:
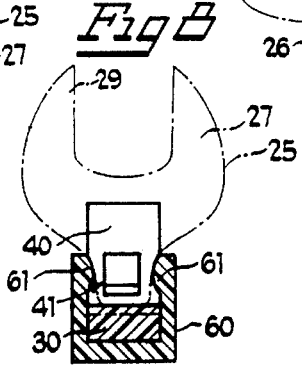
FIG. 8 depicts the wrench inserted into the holder with the sleeve of FIG. 6 in place.

To mount a wrench 25 in a selected space 50, the wrench is aligned as depicted in FIG. 7 above such space and pushed downwardly. The bottom of body 26 contacts entry surfaces 37 and 42 at the same time. As wrench 25 is pushed downwardly, element 35 on one side of the selected space 50 moves away from element 40 on the other side. When wrench 25 is seated as indicated, hole 28 will have passed bosses 36 and 41 and both bosses will enter hole 28, as depicted in FIG. 4.

Figure 9:
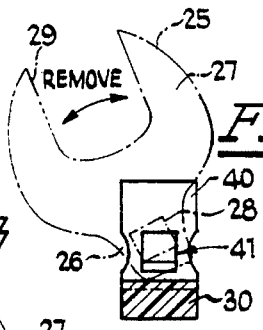
FIG. 9 depicts the wrench preparatory to its removal.

To remove a wrench 25, it may be withdrawn upwardly, whereby the bottom of hole 28 will contact exit surfaces 38 and 43. In continuing to pull upwardly wrench 25 will cause element 35 to move away from its associated element 40, about its associated hinge 45, whereupon wrench 25 can be withdrawn. Alternatively, wrench 25 may be withdrawn by rotating it, as depicted in FIG. 9, which rotation also forces the wrench 25 to move up camming exit surfaces 38 and 43, causing element 35 to hinge along hinge 45 away from element 40 and enable withdrawal of wrench 25.

Figure 6:
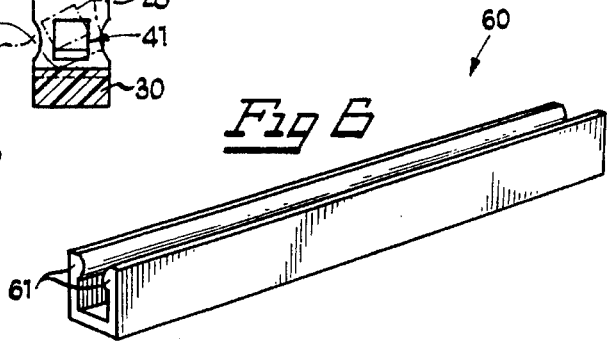
FIG. 6 depicts in perspective view a sleeve which may be used with the wrench holder in FIG. 1.

Referring to FIG. 6, there may be provided a sleeve 60 of a generally U-shape, having a tongue 61 on each side (or just on one side). Each element 35 and 40 has a notch 62 which is shaped complementary to tongue 61. Sleeve 60 is slid onto holder 20 from either end such that tongues 61 reside within notches 62 to prevent wrenches 25 from being removed inadvertently. When it is desired to remove a wrench 25, sleeve 60 is slid out of engagement with holder 20, whereupon the wrenches can be removed in the manner described above.

On the top of each element 40 is imprinted the size of the wrench located in the associated space.

Although each element 35 is connected to an element 40 to its right by way of an associated hinge 45, each element 35 is said to be "associated" with an element 40 to its left to which it is not connected.

What has been described therefore is an improved holder for crowfoot wrenches.

What is claimed is:

1. A holder for use in holding a plurality of crowfoot wrenches each including a wrench head carried by a body having a hole therein, said holder comprising an elongated strip, a plurality of first relatively thick and rigid elements each fixed to and upstanding on said strip, a plurality of second relatively thin and flexible elements alternating with said first elements longitudinally of said strip, each of said first and second elements having an end remote from said strip, hinges respectively connecting said second elements to adjacent ones of said first elements at the remote ends thereof, said second elements respectively cooperating with adjacent ones of said first elements to define a plurality of spaces therebetween, said second elements being respectively hingedly movable toward and away from the adjacent ones of said first elements for accommodating insertion of an associated wrench into and removal of an associated wrench from a selected space, a plurality of first bosses respectively on said first elements and extending laterally with respect thereto, and a plurality of second bosses respectively on said second elements and extending laterally with respect thereto, said first and second bosses defining pairs extending toward each other into said spaces.

2. The holder of claim 1, wherein each of said bosses is substantially square in shape to match the shape of the hole in said wrenches.

3. The holder of claim 1, wherein each of said bosses has a camming exit surface to facilitate removal of said wrenches.

4. The holder of claim 1, wherein each of said bosses has a camming entry surface to facilitate insertion of said wrenches.

5. The holder of claim 4, wherein each of said bosses has a camming exit surface to facilitate removal of said wrenches.

6. The holder of claim 1, wherein said strip and said first and second elements and said bosses are integral and one-piece.

7. The holder of claim 6, wherein each of said elements and said bosses are formed of plastic.

8. The holder of claim 1, and further comprising a sleeve slidable onto said strip and said first and second elements to minimize inadvertent removal of said wrenches.

9. The holder of claim 8, wherein each of said elements has a recess in each side of said element, said sleeve having at least one projection to mate with said recesses when said sleeve is on said strip.

10. The holder of claim 5, wherein the entry and exit surfaces of each boss are intersecting substantially planar surfaces.

11. The holder of claim 1, wherein each of said second elements has a free end spaced from said strip and from said first elements.

12. The holder of claim 1, and further comprising a plurality of feet carried by said strip and respectively projecting into said spaces.

13. The holder of claim 1, wherein each of said first and second bosses is disposed adjacent to said strip.

14. The holder of claim 1, wherein each of said second elements is hinged to move in directions longitudinally of said strip.

* * * * *